US007150252B2

(12) United States Patent
Sugiyama et al.

(10) Patent No.: US 7,150,252 B2
(45) Date of Patent: Dec. 19, 2006

(54) SPARK PLUG AND INTERNAL COMBUSTION ENGINE EQUIPPED WITH THE SPARK PLUG

(75) Inventors: Yoshihisa Sugiyama, Gifu (JP); Katsutoshi Nakayama, Aichi (JP); Takeru Wakamatsu, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 11/385,921

(22) Filed: Mar. 22, 2006

(65) Prior Publication Data

US 2006/0213474 A1 Sep. 28, 2006

(30) Foreign Application Priority Data

Mar. 23, 2005 (JP) ..... 2005-083172

(51) Int. Cl.
*H01T 13/39* (2006.01)

(52) U.S. Cl. ..... 123/169 EL; 313/141; 313/142

(58) Field of Classification Search ..... 123/169 EL, 123/169 R; 313/141, 142
See application file for complete search history.

(56) References Cited

U.S. PATENT DOCUMENTS 4,670,684 A * 6/1987 Kagawa et al. ..... 313/141
5,873,338 A * 2/1999 Matsubara et al. ... 123/169 EL
6,819,032 B1 * 11/2004 Matsubara ..... 313/141
6,864,623 B1 * 3/2005 Ishikawa ..... 313/141
6,885,135 B1 4/2005 Kanao et al.
2002/0158559 A1 * 10/2002 Sugiyama et al. ..... 313/141
2003/0085644 A1 * 5/2003 Sugiyama et al. ..... 313/141
2004/0061421 A1 * 4/2004 Morita et al. ..... 313/142

FOREIGN PATENT DOCUMENTS

JP 2003-197347 7/2003

* cited by examiner

*Primary Examiner*—T. M. Argenbright
(74) *Attorney, Agent, or Firm*—Sughrue Mion, PLLC

(57) ABSTRACT

In a spark plug 100, the nickel content of a center electrode 20 is greater than that of a ground electrode 30. This enhances resistance to spark-induced consumption of the center electrode 20. Also, the ground electrode 30 to which a noble-metal chip 91 is joined exhibits high resistance to spark-induced consumption. Accordingly, the spark plug 100 can be attached to either of a negative-polarity cylinder in which the center electrode 20 assumes a negative polarity, and a positive-polarity cylinder in which the center electrode 20 assumes a positive polarity. The noble-metal chip 91 is joined only to the ground electrode 30, and a noble-metal chip is not joined to the center electrode 20.

8 Claims, 3 Drawing Sheets

SPARK PLUG AND INTERNAL COMBUSTION ENGINE EQUIPPED WITH THE SPARK PLUG

BACKGROUND OF THE INVENTION

1. Technical Field

The present invention relates to a spark plug for an internal combustion engine having a noble metal chip joined only to a ground electrode, and which is adapted to generate spark discharge between the same and a center electrode facing the same, as well as to an internal combustion engine equipped with the spark plug.

2. Description of the Related Art

Conventionally, a spark plug is used for ignition of an internal combustion engine. A spark plug generally includes an insulator having an axial hole axially extending therethrough, and holding a center electrode in a front end portion of the axial hole; a metallic shell surrounding and holding a trunk portion of the insulator; and a ground electrode having a first end welded to a front end of the metallic shell and a second end facing a front end of the center electrode, thereby forming a spark discharge gap therebetween.

In recent years, an increase in temperature in a combustion chamber associated with an improvement in engine output has led to a demand for spark plugs having high-temperature-corrosion resistance and oxidation resistance. In order to reduce electrode consumption which accompanies spark discharge at the time of ignition, there is also a need for resistance to spark-induced consumption. Under these circumstances, a noble-metal chip for enhancing resistance to spark-induced consumption is provided on opposing faces of each of a center electrode and a ground electrode (refer to, for example, Patent Document 1).

In a case where such spark plugs are used in an internal combustion engine, generally, the spark plugs are energized for spark discharge such that the center electrodes assume a negative polarity, whereas the ground electrodes assume a positive polarity. However, in some internal combustion engines, in order to enhance the efficiency of energization, the mounted spark plugs are energized so as to alternate positive polarity and negative polarity from cylinder to cylinder. As compared with an electrode of negative polarity, a positive polarity electrode exhibits greater consumption accompanying spark discharge. Accordingly, such an internal combustion engine employs two kinds of spark plugs; i.e., a spark plug in which resistance to spark-induced consumption of a center electrode is enhanced, and a spark plug in which resistance to spark-induced consumption of a ground electrode is enhanced. These spark plugs are selectively mounted on respective cylinders so as to be compatible with the polarity of the cylinders.

[Patent Document 1] Japanese Patent Application Laid-Open (kokai) No. 2003-197347

3. Problems to be Solved by the Invention

However, for example, replacement of spark plugs has involved potential attachment of a spark plug of the wrong polarity due to human error or the like. Attachment of a spark plug of the wrong polarity to a cylinder involves risk of abnormal consumption of an electrode. This problem can be effectively solved by using a spark plug in which a noble-metal chip is provided on each of a center electrode and a ground electrode so as to enhance resistance to spark-induced consumption, such as the spark plug described in Patent Document 1. This allows use of the same spark plug with a cylinder of either polarity. However, this is disadvantageous in that a noble-metal chip is provided even on an electrode whose consumption is not intensive due to its polarity, with the result that a more expensive spark plug is unnecessarily used.

SUMMARY OF THE INVENTION

The present invention has been achieved in view of the above-noted problems, and an object of the invention is to provide a spark plug which can be attached to a cylinder of either polarity and allows for a reduction in use of a noble-metal chip adapted to enhance resistance to spark-induced consumption, as well as an internal combustion engine equipped with the spark plug.

In a first aspect (1), the above object has been achieved by providing a spark plug which comprises a center electrode containing nickel; an insulator having an axial hole extending along an axial direction of the center electrode, and holding the center electrode in the axial hole; a metallic shell radially surrounding and holding the insulator; a ground electrode containing nickel as a main component and having a first end portion joined to the metallic shell and a second end portion facing the center electrode; and a noble-metal chip containing platinum or iridium as a main component and joined to the second end portion of the ground electrode. The spark plug generates spark discharge between the center electrode and the noble-metal chip. The nickel content of the center electrode is greater than that of the ground electrode In a second aspect (2), the nickel content of the center electrode is greater than the nickel content of the ground electrode by 10 wt. % or more.

In a third aspect (3), the spark plug of the invention is characterized in that, in addition to the configuration according to (1) or (2) above, the nickel content of the center electrode is 96 wt. % or more, and the nickel content of the ground electrode is 78.5 wt. % or less.

In a fourth aspect (4), the spark plug of the invention is characterized in that, in addition to the configuration according to any of (1) to (3) above, a front end portion of the center electrode has an outside diameter of 1.5 mm or more.

In a fifth aspect (5), the invention relates to an internal combustion engine which comprises a spark plug according to any one of (1) to (4) above; and a cylinder having the spark plug attached thereto and being activated by application of a discharge voltage to the spark plug such that the center electrode of the spark plug assumes a positive polarity, whereas the ground electrode of the spark plug assumes a negative polarity.

EFFECT OF THE INVENTION

In the spark plug of the invention according to (1) above, the nickel content of the center electrode on which a noble-metal chip is not present is greater than the nickel content of the ground electrode on which the noble-metal chip is joined. This enhances resistance to spark-induced consumption of the center electrode, so that there is no need to join a noble-metal chip, whose resistance to spark-induced consumption is high, to the center electrode.

In a condition where the spark plug is attached to an internal combustion engine, the ground electrode has a higher heat load than the center electrode. However, since the nickel content of the ground electrode is lower than that of the center electrode, the content of components in the ground electrode having a high resistance to oxidation and a high-temperature corrosion can be increased accordingly. Furthermore, by joining the noble-metal chip to the ground electrode, the resistance of the ground electrode to spark-induced consumption is enhanced. When a spark plug whose center and ground electrodes are thus enhanced in terms of resistance to spark-induced consumption is attached to either a negative-polarity cylinder in which the center electrode assumes a negative polarity or a positive-polarity cylinder in which the center electrode assumes a positive polarity, the spark plug can exhibit excellent resistance to spark-induced consumption. In other words, in the spark plug of the invention which can be used with either of a positive-polarity cylinder and a negative-polarity cylinder, a noble-metal chip need only be attached to the ground electrode. As such, product cost is reduced, and the life of the spark plug can be extended.

The spark plug of the invention according to (3) above can yield, in addition to the effect of the invention according to (1) above, the following effect. Since the nickel content of the center electrode is 96 wt. % or more, resistance to spark-induced consumption of the center electrode can be reliably enhanced without joining a noble-metal chip to the center electrode. Meanwhile, in a condition where the spark plug is attached to an internal combustion engine, the ground electrode has a heat load that is greater than that of the center electrode. However, since the nickel content of the ground electrode is lower than that of the center electrode, the content of components in the ground electrode other than nickel can be increased; i.e., the content of components which enhance resistance to oxidation and high-temperature corrosion can be increased. Impaired resistance to spark-induced consumption which the ground electrode could suffer as a result of a reduction in nickel content can be avoided by attaching a noble-metal chip, such that even the resistance to spark-induced consumption can be enhanced. Also, a nickel content of the ground electrode of 78.5 wt. % or less improves weldability between the ground electrode and the noble-metal chip.

The spark plug of the invention according to (4) above employs a center electrode whose front end portion has an outside diameter of 1.5 mm or more, thereby facilitating attainment of a durability level demanded by the market. The effectiveness of employing such a diameter is described in the evaluation test section below.

In the internal combustion engine of the invention according to (5) above, a discharge voltage is applied to the spark plug such that the center electrode of the spark plug assumes a positive polarity, whereas the ground electrode of the spark plug assumes a negative polarity. Preferably, a spark plug having the above-described configuration is used in a condition where the positive polarity of an external power source is connected to its center electrode, and in an internal combustion engine whose cylinders provide such polarity.

DESCRIPTION OF REFERENCE NUMERALS

Figure 1:
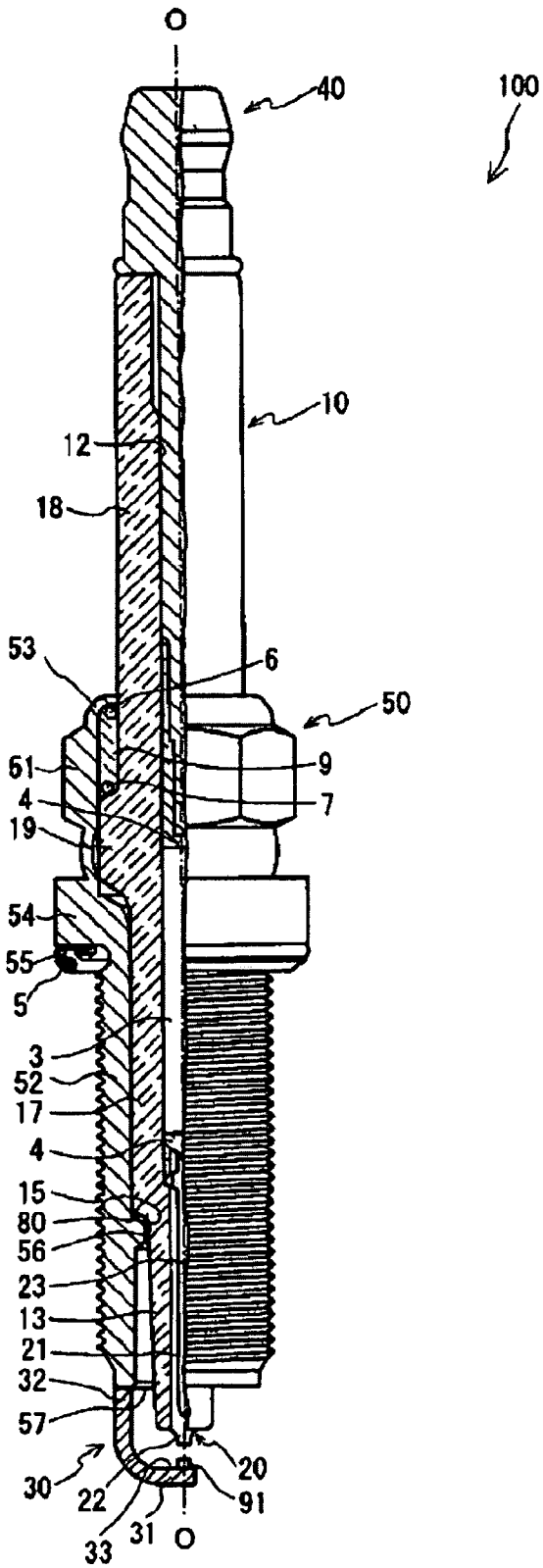
FIG. 1 is a partial sectional view of a spark plug 100.

Reference numerals used to identify various structural features in the drawings include the following.

| | |
|---|---|
| 10: | insulator |
| 12: | axial hole |
| 20: | center electrode |
| 22: | front end portion |
| 30: | ground electrode |
| 31: | distal end portion |
| 32: | proximal end portion |
| 50: | metallic shell |
| 91: | noble-metal chip |
| 100: | spark plug |
| 200: | internal combustion engine |
| 210, 220: | cylinder |

DETAILED DESCRIPTION OF THE PREFERRED EMBODIMENTS

A spark plug according to an embodiment of the present invention and an internal combustion engine equipped with the spark plug will next be described in detail with reference to the drawings. However, the present invention should not be construed as being limited thereto.

First, by reference to FIG. 1, the structure of a spark plug 100 of the present embodiment will be described. FIG. 1 is a partial sectional view of the spark plug 100. In the following description, a direction of an axis O toward a center electrode 20 held in an axial hole 12 of an insulator 10 is taken as a front end side of the spark plug 100.

As shown in FIG. 1, the spark plug 100 includes the insulator 10; a metallic shell 50 provided at a substantially central portion of the insulator 10 with respect to a longitudinal direction of the insulator 10 and holding the insulator 10; the center electrode 20 being held in the axial hole 12 of the insulator 10 along the axial direction; a ground electrode 30 whose first end portion (proximal end portion 32) is welded to a front end surface 57 of the metallic shell 50 and whose second end portion (distal end portion 31) faces a front end portion 22 of the center electrode 20; and a metallic terminal member 40 provided rearward of the center electrode 20.

First, the insulator 10 of the spark plug 100 will be described. As is well known, the insulator 10 is a tubular, electrically insulative member which is formed of alumina or the like by firing and has axial hole 12 extending along the direction of the axis O. A flange portion 19 having the largest outside diameter is formed at substantially the center with respect to the direction of the axis O. A rear trunk portion 18 is formed rearward of the flange portion 19. A front trunk portion 17 having an outside diameter smaller than that of the rear trunk portion 18 is formed frontward of the flange portion 19. A leg portion 13 having an outside diameter smaller than that of the front trunk portion 17 is formed frontward of the front trunk portion 17. The diameter of the leg portion 13 is reduced toward its front end. When the spark plugs 100 are attached to respective cylinders 210 and 220 (see FIG. 3) of an internal combustion engine 200, their leg portions 13 are exposed to respective combustion chambers 211 and 221.

Next, the center electrode 20 will be described. The center electrode 20 is a rodlike electrode configured such that a core 23 formed of copper or a copper alloy for promoting heat release is embedded at a central portion of an electrode base metal 21 of an alloy having a high nickel content, such as material c in Table 1, which will be described below. The front end portion 22 of the center electrode 20 projects from a front end surface of the insulator 10 and is formed such that its diameter is reduced toward its front end. The center electrode 20 is electrically connected to the metallic terminal member 40 located thereabove via a seal member 4 and a resistor 3 provided in the axial hole 12. A high-voltage cable (not shown) is connected to the metallic terminal member 40 via a plug cap (not shown) so as to apply a high voltage thereto.

Next, the metallic shell 50 will be described. The metallic shell 50 is adapted to hold the insulator 10 and fix the spark plug 100 to the internal combustion engine 200 (see FIG. 3). The metallic shell 50 holds the insulator 10 so as to surround the following portions of the insulator 10: a portion of the rear trunk portion 18 located in the vicinity of the flange portion 19, the flange portion 19, the front trunk portion 17, and the leg portion 13. The metallic shell 50 is formed of a low-carbon steel and includes a tool engagement portion 51 to which an unillustrated spark plug wrench is fitted, and an external-thread portion 52 which is engaged with a cylinder head 212 or 222 (see FIG. 3) provided at an upper portion of the internal combustion engine.

Ring members 6 and 7 are interposed between the tool engagement portion 51 of the metallic shell 50 and the rear trunk portion 18 of the insulator 10. A talc powder 9 is filled between the ring members 6 and 7. A crimp portion 53 is formed rearward of the tool engagement portion 51. By crimping the crimp portion 53, the insulator 10 is pressed frontward in the metallic shell 50 via the ring members 6 and 7 and the talc powder 9. By this procedure, a stepped portion 15 of the insulator 10 located between the front trunk portion 17 and the leg portion 13 is supported, via a sheet packing 80, on a stepped portion 56 formed along the inner circumference of the metallic shell 50, whereby the metallic shell 50 and the insulator 10 are united. The sheet packing 80 maintains airtightness between the metallic shell 50 and the insulator 10, thereby preventing outflow of combustion gas. A flange portion 54 is formed at a central portion of the metallic shell 50. A gasket 5 is fitted to a portion of the metallic shell 50 located in the vicinity of and rearward (upward in FIG. 1) of the external-thread portion 52; in other words, the gasket 5 is fitted to a seat surface 55 of the flange portion 54.

Next, the ground electrode 30 will be described. The ground electrode 30 is formed of a metal having high a corrosion resistance; for example, a Ni alloy such as INCONEL (trade name) 600 or 601. The ground electrode 30 has a substantially rectangular cross section taken perpendicularly to its longitudinal direction. The proximal end portion 32 is welded to the front end surface 57 of the metallic shell 50. The distal end portion 31 of the ground electrode 30 is bent so as to face the front end portion 22 of the center electrode 20. An inner surface 33 of the ground electrode 30 which faces the center electrode 20 is substantially perpendicular to the axial direction of the center electrode 20. A columnar noble-metal chip 91 whose main component is platinum (Pt) or iridium (Ir) is resistance-welded to the inner surface 33, whereby a spark discharge gap is formed between the noble-metal chip 91 and the front end portion 22 of the center electrode 20.

Figure 3:
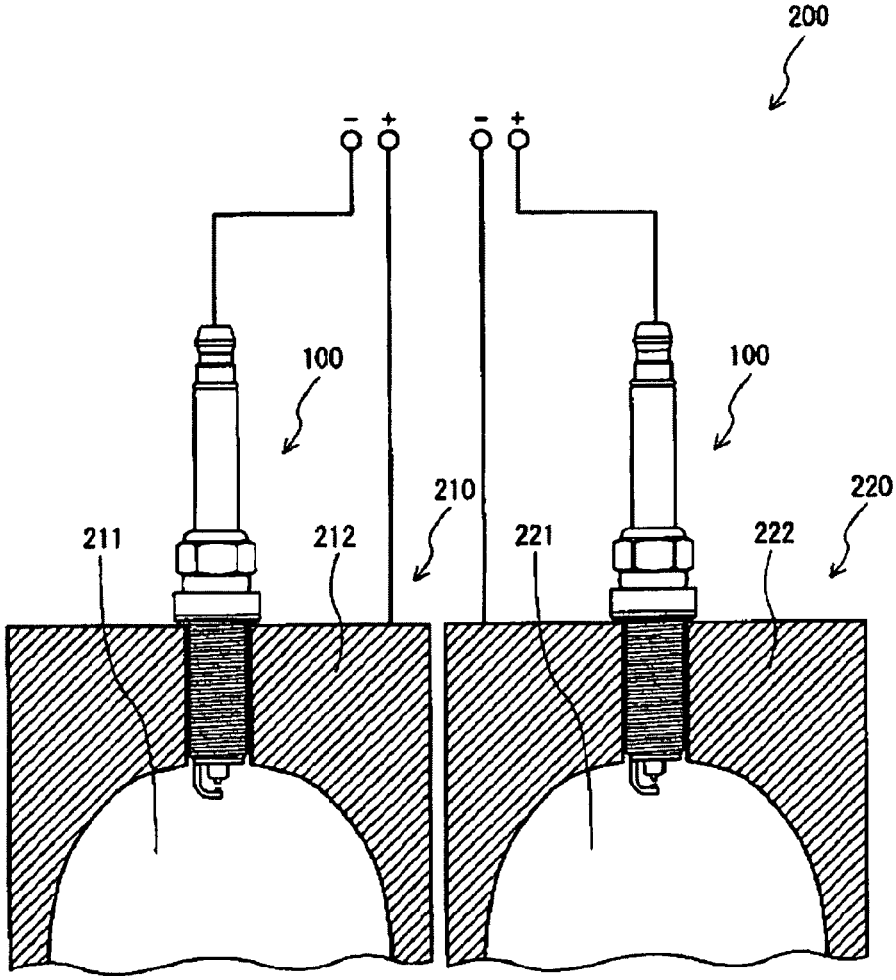
FIG. 3 is a partial sectional view showing spark plugs 100 attached to respective cylinders 210 and 220.

When the thus-configured spark plugs 100 are attached to the internal combustion engine 200 as shown in FIG. 3, the center electrodes 20 and the ground electrodes 30 which form respective spark discharge gaps therebetween are exposed to the combustion chambers 211 and 221 of the cylinders 210 and 220. Particularly, since the spark plugs are mounted such that ground electrodes 30 project into the respective combustion chambers 211 and 221, the ground electrodes 30 have a higher heat load than the center electrodes 20. Accordingly, in the present embodiment, the amount of Ni contained in a base metal of the ground electrode 30 is made smaller than that of the center electrode 20. Consequently, the ground electrode 30 can contain a greater amount components which implement performance required of electrodes, such as corrosion resistance and oxidation resistance. Also, provision of the noble-metal chip 91 implements resistance to spark-induced consumption. Meanwhile, the center electrode 20 has a lower heat load than that of the ground electrode 30. Thus, by incorporating a greater amount of Ni in a base metal of the center electrode 20 as compared with the ground electrode 30, preferably in an amount that is greater by 10 wt. % or more, resistance to spark-induced consumption can be enhanced without attaching a noble-metal chip.

Specifically, on the basis of the results of an evaluation test, which will be described below, the Ni content of the center electrode 20 is advantageously determined to be 96 wt. % or more, and the Ni content of the ground electrode 30 is determined to be 78.5 wt. % or less. When the Ni content of the center electrode 20 is less than 96 wt. % and particularly when spark discharge is generated with the center electrode 20 assuming a negative polarity, spark-induced consumption of the center electrode 20 is increased. Meanwhile, when the Ni content of the ground electrode 30 is in excess of 78.5 wt. %, weldability of the ground electrode 30 to the noble-metal chip 91 is deteriorated, raising the risk of separation of the noble-metal chip 91 from the ground electrode 30.

However, a Ni content of the center electrode 20 of 100 wt. % is not preferred. Desirably, other components which enhance corrosion resistance and oxidation resistance are incorporated into the center electrode 20. In consideration of the content of such other components, the Ni content of the center electrode is preferably 98.5 wt. % or less. Also, preferably, the ground electrode 30 contains Ni in an amount of at least 56 wt. % so as to avoid impairment of oxidation resistance and its performance as a heat-resistant alloy.

Examples of components capable of implementing performance required of electrodes, such as corrosion resistance and oxidation resistance, include silicon (Si), aluminum (Al), manganese (Mn), chromium (Cr), neodymium (Nd), and iron (Fe). Si enhances corrosion resistance and resistance to spark-induced consumption at high temperature. Al forms an oxide film on the surface of an electrode to thereby enhance corrosion resistance at high temperature. Mn is known to exhibit a deoxidizing function and a desulfurizing function in a melting process during the course of preparing the electrode material and in a welding process. Cr and Fe form an oxide film on the surface of an electrode to thereby enhance corrosion resistance. Nd suppresses grain growth in the surface of an electrode.

Preferably, the outside diameter of the front end portion 22 of the center electrode 20 is greater than that of the noble-metal chip 91. As mentioned above, since the center electrode 20 contains Ni in a large amount, its resistance to spark-induced consumption is high; however, as compared with the center electrode 20, the noble metal chip 91 which contains Pt or Ir as a main component exhibits higher resistance to spark-induced consumption.

By conforming to the above-mentioned requirements (particularly Ni content) for materials of the center electrode 20, and the ground electrode 30 to which the noble-metal chip 91 is welded, the spark plug 100 can exhibit excellent resistance to spark-induced consumption. This is the case even when, as shown in FIG. 3, the spark plug 100 is attached to either the positive-polarity cylinder 210 in which the center electrode assumes a positive polarity or the negative polarity cylinder 220 in which the center electrode assumes a negative polarity.

Example 1

In order to confirm the effect where the Ni content of the center electrode 20 is greater than that of the ground electrode 30, an evaluation test was conducted.

In the evaluation test, five kinds of electrode materials of differing composition (see Table 1) were prepared. Center electrodes and ground electrodes were formed using these materials. Eleven kinds of sample spark plugs (see Table 2) were fabricated for the evaluation test. As shown in Table 1, material a is an alloy containing 96 wt. % Ni, 1.2 wt. % Si, 1.2 wt. % Cr and 1.6 wt. % Mn. Material b is an alloy containing 78.5 wt. % Ni, 0.5 wt. % Si, 14 wt. % Cr, 1.0 wt. % Mn and 6 wt. % Fe. Material c is an alloy containing 98.5 wt. % Ni, 0.5 wt. % Si, 0.8 wt. % Al and 0.2 wt. % Nd. Material d is an alloy containing 56 wt. % Ni, 0.5 wt. % Si, 1.7 wt. % Al, 25 wt. % Cr, 1.0 wt. % Mn and 15.8 wt. % Fe. Material e is an alloy containing 91 wt. % Ni, 1.5 wt. % Si, 0.5 wt. % Al, 2 wt. % Cr, 2 wt. % Mn and 3 wt. % Fe.

TABLE 1

| | Composition (wt. %) | | | | | | |
|---|---|---|---|---|---|---|---|
| Material | Ni | Si | Al | Nd | Cr | Mn | Fe |
| a | 96 | 1.2 | — | — | 1.2 | 1.6 | — |
| b | 78.5 | 0.5 | — | — | 14 | 1.0 | 6 |
| c | 98.5 | 0.5 | 0.8 | 0.2 | — | — | — |
| d | 56 | 0.5 | 1.7 | — | 25 | 1.0 | 15.8 |
| e | 91 | 1.5 | 0.5 | — | 2 | 2 | 3 |

As shown in Table 2, the spark plug of Sample No. 1 was fabricated using a center electrode formed of material a, and a ground electrode formed of material b. Similarly, the spark plugs of Sample Nos. 2 to 11 were fabricated using respective center electrodes formed of materials d, d, a, a, a, a, e, c, a and a, and respective ground electrodes formed of materials a, b, a, b, b, b, b, b, e and d. The center electrodes were fabricated such that their front end portions have an outside diameter of 1.5 mm. The ground electrodes were fabricated such that their sections taken perpendicularly to their longitudinal direction measured 1.5 mm×2.8 mm. In the spark plugs of Sample Nos. 5 and 6, the noble-metal chip was resistance-welded to the front end surface of the front end portion of the center electrode. Similarly, in the spark plugs of Sample Nos. 1 to 4, 6 and 8 to 11, the noble-metal chip was resistance-welded to the inner surface of the distal end portion of the ground electrode. The noble-metal chips were formed of Pt-20Ni (20 atom % Ni) in a disklike shape measuring 0.7 mm (dia.)×0.3 mm.

The thus-fabricated eleven kinds of spark plugs were evaluated for resistance to spark-induced consumption and weldability.

First, in the evaluation for resistance to spark-induced consumption, two spark plugs were fabricated for each of the samples. In these samples, the degree of bending of the ground electrodes was adjusted so as to form a spark discharge gap of 1.05 mm. The extent of projection of the front end surface (the front end surface of a noble-metal chip if provided) of the center electrode from the front end surface of the insulator, and the dimension between the inner surface (a surface which faces the center electrode) of the ground electrode and the distal end surface of the noble-metal chip (the thickness of the ground electrode if the noble-metal chip is not provided) was measured for each of these samples. The two spark plugs of each sample were subjected to spark discharge at 60 Hz in an atmosphere of 0.4 MPa for 100 hours such that the center electrode of one spark plug assumed a positive polarity, whereas the center electrode of the other spark plug assumed a negative polarity. An increase in the spark discharge gap was then measured. In each sample, an increase in the spark discharge gap was compared between the spark plug of one polarity (where the center electrode assumed a positive polarity) and the spark plug of the other polarity (where the center electrode assumed a negative polarity). When both the spark plug of one polarity and the spark plug of the other polarity exhibited an increase in spark discharge gap of less than 0.1 mm, the associated sample was graded "o," indicating excellent resistance to spark-induced consumption. When a spark plug of either polarity exhibited an increase in spark discharge gap of 0.1 mm or more, the associated sample was graded "x," indicating poor resistance to spark-induced consumption.

On the basis of the results of the evaluation test for resistance to spark-induced consumption, the center electrodes of the spark plugs were graded as follows: "o" for Sample Nos. 1, 4 to 7 and 9 to 11, and "x" for Sample Nos. 2, 3 and 8. The evaluation results of the ground electrodes of the samples were as follows: "o" for Sample Nos. 1 to 4, 6, 8, 9 and 11, and "x" for Sample Nos. 5, 7 and 10.

An evaluation test for weldability was conducted on the spark plugs of Sample Nos. 5 and 6 in which the noble-metal chip was resistance-welded to the center electrode, and on the spark plugs of Sample Nos. 1 to 4, 6 and 8 to 11 in which the noble-metal chip was resistance-welded to the ground electrode.

Figure 2:
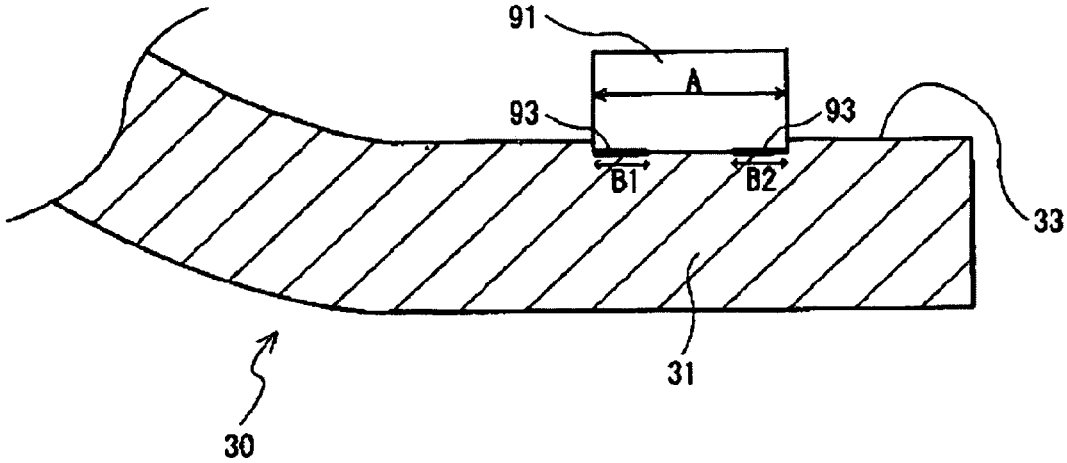
FIG. 2 is a view illustrating a test rig for evaluating weldability.

As shown in FIG. 2, the ground electrode 30 and the noble-metal chip 91 resistance-welded to the inner surface 33 of the ground electrode 30 were heated at 900° C. for 2 minutes using a burner and were then allowed to cool naturally (i.e., without forced cooling) for 1 minute. This procedure was taken as one cycle and was carried out for 1,000 cycles. Subsequently, the welded ground electrode 30 and noble-metal chip 91 of each sample were cut along a plane passing through the axis of the noble-metal chip 91, and the cut surface of a weld zone of the ground electrode 30 and the noble-metal chip 91 was observed using a magnifier. On the cut surface of the weld zone, lengths B1 and B2 of separated portions 93 extending along a direction perpendicular to the axis of the noble-metal chip 91 (the maximum length of separation as measured on the cut surface) were measured.

The measured lengths B1 and B2 were compared with the previously measured outside diameter A of the noble-metal chip 91. When a percentage defined by (B1+B2)/A×100 (%) was less than 50%, the sample was graded "o" indicating excellent weldability. When the percentage was 50% or more, the sample was graded "x," indicating poor weldability and potential separation of the noble-metal chip.

In Sample Nos. 5 and 6, the noble-metal chip was joined to the front end surface of the front end portion of the center electrode. By the above-mentioned method, the evaluation test for weldability was also conducted on these noble-metal chips.

On the basis of the results of the evaluation test for weldability, Sample Nos. 5 and 6 in which the noble-metal chip was joined to the center electrode were graded "x." Among those samples in which the noble-metal chip was joined to the ground electrode, Sample Nos. 1, 3, 6, 8, 9 and 11 were graded "o," and sample Nos. 2, 4 and 10 were graded "x."

On the basis of the results of the evaluation test for resistance to spark-induced consumption and weldability, the samples were comprehensively evaluated. When the evaluation results of a sample included even a single "x," the sample was comprehensively graded "x," indicating that the sample is not appropriate for use as a bipolar spark plug. When the evaluation results of a sample did not include "x," the sample was comprehensively graded "o" indicating that the sample is appropriate for use as a bipolar spark plug. As shown in Table 2, Sample Nos. 1, 9 and 11 were comprehensively graded "o," whereas Sample Nos. 2 to 8 and 10 were comprehensively graded "x."

or less and having a noble-metal chip joined thereto can exhibit the required performance.

Example 2

The degree of influence of the outside diameter of a front end portion of a center electrode on durability was verified. The comparative verification was made using the spark plug of Sample No. 1 which exhibited good results of the evaluation test conducted in Example 1. Five kinds of samples having an outside diameter of a front end portion of a center electrode of 1.5 mm, 1.1 mm, 1.7 mm, 2.5 mm and 3.0 mm were fabricated. The samples were subjected to spark discharge at 60 Hz in an atmosphere of 0.6 MPa such that their center electrodes assumed a negative polarity. This test employed a desktop spark tester, and spark discharge equivalent to running 50,000 miles was carried out. After the test, the discharge voltage of the respective samples was measured. A sample which exhibited an allowance, after the

TABLE 2

| | Center electrode | | | | | Ground electrode | | | | | |
|---|---|---|---|---|---|---|---|---|---|---|---|
| Sample | Material | Ni (wt. %) | Noble metal chip | Resistance to spark-induced consumption | Weldability | Material | Ni (wt. %) | Noble metal chip | Resistance to spark-induced consumption | Weldability | Comprehensive evaluation |
| 1 | a | 96 | — | ○ | — | b | 78.5 | Yes | ○ | ○ | ○ |
| 2 | d | 56 | — | x | — | a | 96 | Yes | ○ | x | x |
| 3 | d | 56 | — | x | — | b | 78.5 | Yes | ○ | ○ | x |
| 4 | a | 96 | — | ○ | — | a | 96 | Yes | ○ | x | x |
| 5 | a | 96 | Yes | ○ | x | b | 78.5 | — | x | — | x |
| 6 | a | 96 | Yes | ○ | x | b | 78.5 | Yes | ○ | ○ | x |
| 7 | a | 96 | — | ○ | — | b | 78.5 | — | x | — | x |
| 8 | e | 91 | — | x | — | b | 78.5 | Yes | ○ | ○ | x |
| 9 | c | 98.5 | — | ○ | — | b | 78.5 | Yes | ○ | ○ | ○ |
| 10 | a | 96 | — | ○ | — | e | 91 | Yes | x | x | x |
| 11 | a | 96 | — | ○ | — | d | 56 | Yes | ○ | ○ | ○ |

As is apparent from comparison of the results of the evaluation test for resistance to spark-induced consumption and weldability among Sample Nos. 1, 3, 8 and 9 which differed in material for the center electrode, when the Ni content of the center electrode was less than 96 wt. %, spark-induced consumption of the center electrodes increased; i.e., resistance to spark-induced consumption is impaired. Also, as is apparent from comparison of the test results among Sample Nos. 1, 4, 10 and 11 which differed in material for the ground electrode, when the Ni content of the ground electrode was in excess of 78.5 wt. %, a separated portion arose in a weld zone of the noble-metal chip; i.e., weldability was impaired. These findings can also be confirmed from the evaluation test results of Sample No. 2 which failed to meet the criteria for the Ni content of the center electrode and the Ni content of the ground electrode.

As is apparent from comparison of the test results among Sample Nos. 1 and 5 to 7, even when the noble-metal chip was joined to the center electrode whose Ni content was 96 wt. % or more, weldability was impaired; and when the noble-metal chip was not joined to the ground electrode whose Ni content was 78.5 wt. %, resistance to spark-induced consumption of the ground electrode was impaired.

Figure 4:
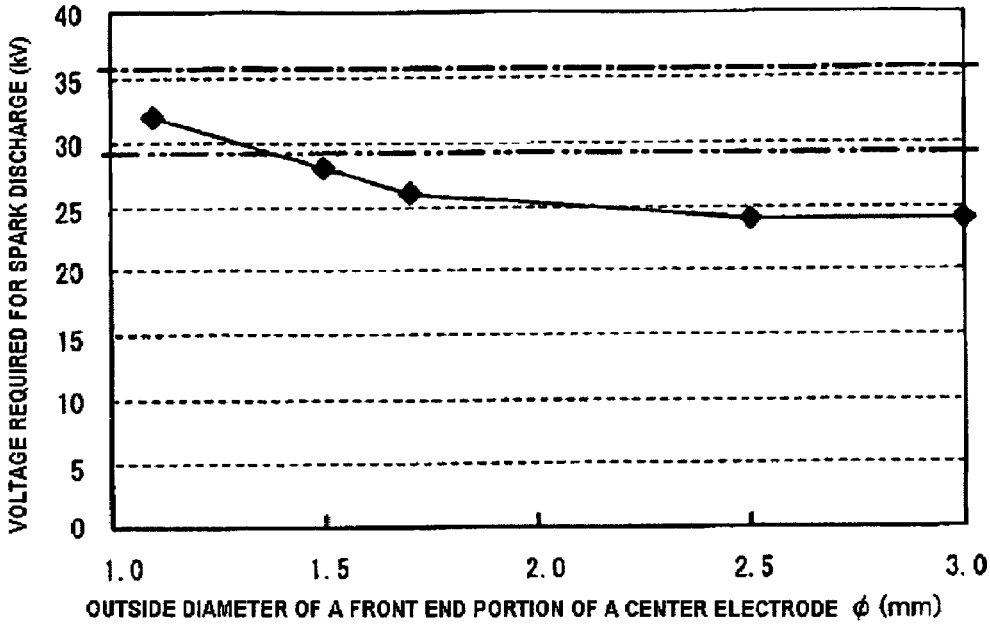
FIG. 4 is a graph showing the relationship between the outside diameter of a front end portion of a center electrode and voltage required for spark discharge as observed after the spark plugs have been subjected to spark discharge equivalent to running 50,000 miles.

As is apparent from the test results of Sample Nos. 1, 9 and 11, even when attached to a cylinder of either positive polarity and negative polarity, a spark plug which includes a center electrode having an Ni content of 96 wt. % or more and a ground electrode having an Ni content of 78.5 wt. % test, of 20% or more in the output (36 kV, as represented by the dot-and-dash line in FIG. 4) of a power source thus employed (i.e., a sample which was able to generate spark discharge at a discharge voltage of 29 kV or less, as represented by the two-dot-and-dash line in FIG. 4) was evaluated as "good" indicating that significant impairment in durability was not observed.

As shown in the graph of FIG. 4 indicating the test results, the sample having an outside diameter of the front end portion of the center electrode of 1.1 mm required a voltage of 32 kV for generating spark discharge after the test, whereas those samples having an outside diameter of the front end portion of the center electrode of 1.5 mm, 1.7 mm, 2.5 mm and 3.0 mm required spark discharge generating voltages of 28 kV, 26 kV, 24 kV, and 24 kV, respectively. This reveals that a reduction in the outside diameter of a front end portion of a center electrode leads to impairment in durability. Consequently, consumption of the electrode associated with spark discharge increases the spark discharge gap, with the result that electric power required for spark discharge is increased. Thus, employing an outside diameter of a front end portion of a center electrode of 1.5 mm or more is effective for attaining sufficient durability.

The present invention may also be embodied in various other forms. For example, no particular limitation is imposed on the content of components other than Ni contained in the center electrode 20 and the ground electrode 30, so long as the Ni content satisfies the above described requirements. The noble-metal chip 91 is resistance-welded to the ground electrode 30, but may be laser-welded to the ground electrode 30. A front end portion of the center electrode is formed such that its outside diameter is reduced toward the front end. However, the present invention is not limited thereto. Of course, for example, features of the spark plug 100 which are not directly related to spark discharge, such as size and shape, may be modified as appropriate.

The greater the outside diameter of a front end portion of a center electrode, the higher the durability; however, heat tends to be drawn from a growing flame nucleus, raising concern about impairment in ignition performance. In this case, by employing an outside diameter of the center electrode greater than the width of the ground electrode, impairment in ignition performance is effectively suppressed. Particularly, an outside diameter of a front end portion of the center electrode of 2.0 mm or more was confirmed to be more effective.

INDUSTRIAL APPLICABILITY

The present invention can be applied to a spark plug which can be attached to a cylinder of either positive polarity and negative polarity, as well as to an internal combustion engine equipped with the spark plug.

It should further be apparent to those skilled in the art that various changes in form and detail of the invention as shown and described above may be made. It is intended that such changes be included within the spirit and scope of the claims appended thereto.

This application is based on Japanese Patent Application No. 2005-83172 filed Mar. 23, 2005 incorporated herein by reference in its entirety.

What is claimed is:

1. A spark plug comprising:

a center electrode containing nickel;

an insulator having an axial hole extending along an axial direction of the center electrode, and holding the center electrode in the axial hole;

a metallic shell radially surrounding and holding the insulator;

a ground electrode containing nickel as a main component and having a first end portion joined to the metallic shell and a second end portion facing the center electrode; and a noble-metal chip containing platinum or iridium as a main component and joined to the second end portion of the ground electrode;

the spark plug generating spark discharge between the center electrode and the noble-metal chip; and wherein the nickel content of the center electrode is greater than the nickel content of the ground electrode.

2. The spark plug according to claim 1, wherein the nickel content of the center electrode is greater than the nickel content of the ground electrode by 10 wt. % or more.

3. The spark plug according to claim 1, wherein the nickel content of the center electrode is 96 wt. % or more, and the nickel content of the ground electrode is 78.5 wt. % or less.

4. The spark plug according to claim 2, wherein the nickel content of the center is 96 wt. % or more, and the nickel content of the ground electrode is 78.5 wt. % or less.

5. The spark plug according to claim 1, wherein a front end portion of the center electrode has an outside diameter of 1.5 mm or more.

6. The spark plug according to claim 1, wherein a noble-metal chip is not joined to the center electrode.

7. An internal combustion engine comprising:

a spark plug according to claim 1; and a cylinder having the spark plug attached thereto and being activated by application of a discharge voltage to the spark plug such that the center electrode of the spark plug assumes a positive polarity, whereas the ground electrode of the spark plug assumes a negative polarity.

8. An internal combustion engine comprising:

a cylinder including a combustion chamber and a spark plug attached to the cylinder, said spark plug having a spark discharging end projecting into said combustion chamber;

said spark plug comprising:

a center electrode containing nickel;

an insulator having an axial hole extending along an axial direction of the center electrode, and holding the center electrode in the axial hole;

a metallic shell radially surrounding and holding the insulator;

a ground electrode containing nickel as a main component and having a first end portion joined to the metallic shell and a second end portion facing the center electrode; and a noble-metal chip containing platinum or iridium as a main component and joined to the second end portion of the ground electrode;

the spark plug generating spark discharge between the center electrode and the noble-metal chip;

wherein the nickel content of the center electrode is greater than the nickel content of the ground electrode; and said internal combustion engine further comprising means for applying a discharge voltage to the spark plug such that the center electrode of the spark plug assumes a positive polarity and the ground electrode assumes a negative polarity.

* * * * *